US006133883A

United States Patent [19]

Munson et al.

[11] Patent Number: 6,133,883

[45] Date of Patent: Oct. 17, 2000

[54] WIDE BAND ANTENNA HAVING UNITARY RADIATOR/GROUND PLANE

[75] Inventors: Robert Eugene Munson, Boulder; Randy Cecil Bancroft, Denver; Blaine Rexel Bateman, Louisville; Joseph Theofil Negler, Boulder; Alexis Uspenski, Boulder; Edward Earl Ward, Boulder, all of Colo.

[73] Assignee: Xertex Technologies, Inc., Broomfield, Colo.

[21] Appl. No.: 09/441,529

[22] Filed: Nov. 16, 1999

Related U.S. Application Data

[63] Continuation-in-part of application No. 09/193,781, Nov. 17, 1998, Pat. No. 6,049,314.

[51] Int. Cl.[7] ..... H01Q 1/38

[52] U.S. Cl. ..... 343/700 MS; 343/846

[58] Field of Search ..... 343/700 MS, 767, 343/770, 795, 828, 829, 830, 846, 848, 906; 200/600

[56] References Cited

U.S. PATENT DOCUMENTS 4,700,194 10/1987 Ogawa et al. ..... 343/700 MS
4,835,541 5/1989 Johnson et al. ..... 343/700 MS
5,355,142 10/1994 Marshall et al. ..... 343/700 MS
5,444,453 8/1995 Lalezari ..... 343/700 MS
5,532,707 7/1996 Klinger et al. ..... 343/793
5,734,350 3/1998 Deming et al. ..... 343/700 MS
6,049,314 4/2000 Munson et al. ..... 343/846

*Primary Examiner*—Tan Ho
*Attorney, Agent, or Firm*—F. A. Sirr; E. C. Hancock; Holland & Hart LLP

[57] ABSTRACT

An antenna is formed from a single sheet of generally planar metal that is cut to provide four geometric antenna shapes that comprise a ground plane element, a two-section shorting element that is defined by two generally parallel fold lines, a radiating element, and an arm that has one end fixed to a generally central portion of the radiating element and has a free end that extends toward a fold line. Folding the metal sheet on the two fold lines positions the radiating element above the ground plane element. A transmit/receive coaxial cable is aligned with a gap that is formed between the two sections of the shorting element. The cable's outer metal sheath is connected to a metal tab, and the metal tab is secured to a surface of the ground plane element. The cable's center conductor is secured to a surface of the radiating element. A radome and its mounting tab complete the antenna assembly.

24 Claims, 8 Drawing Sheets

WIDE BAND ANTENNA HAVING UNITARY RADIATOR/GROUND PLANE

CROSS-REFERENCE TO RELATED APPLICATIONS

This application is a continuation in part of U.S. patent application Ser. No. 09/193,781, filed Nov. 17, 1998, now U.S. Pat. No. 6,049,314 entitled WIDE BAND ANTENNA HAVING UNITARY RADIATOR/GROUND PLANE.

This application relates to U.S. Pat. No. 5,734,350, issued on Mar. 31, 1998, which patent is incorporated herein by reference.

An antenna in accordance with this invention may be used to good advantage with the radome that is taught by copending PCT Patent Application PCT/US97/05716, filed Apr. 8, 1997, specifying the United States as a continuation in part application, which application is incorporated herein by reference.

BACKGROUND OF THE INVENTION

1. Field of the Invention

The present invention relates to receiving and transmitting antennas. More particularly, the present invention relates to RF antennas having a relatively low physical volume profile. While not limited thereto, the present invention is particularly useful for high frequency RF signal exchanges at relatively low power and over short ranges.

2. Description of the Related Art

Several varieties of flat Radio Frequency (RF) antennas have evolved in the past.

U.S. Pat. No. 4,835,541 to Johnson et al provides a quarter wavelength microstrip antenna structure that includes a thin conductive copper sheet that is folded over to form the shape of the letter "U". The copper sheet, thus folded, provides an upper radiating surface section that defines a first conductive surface, a lower ground plane section that is parallel to the first section and defines a second conductive surface, and a shorting section that connects the upper and lower sections, with the upper and lower sections each meeting the shorting section at a right angle. The cavity that is defined by the upper section and the lower section is a quarter wavelength resonant cavity. A hole is drilled through the shorting section, and a coaxial cable is passed through the hole. The outer cable sheath is electrically connected to the lower section and the center cable conductor is connected to the upper section, and in one embodiment this latter connection is provided by way of an impedance matching network. The shorting section electrically connects the lower section to an edge of the upper section, thus this upper section edge is at the same potential as the lower section.

U.S. Pat. No. 5,355,142 by Marshall et al provides a quarter wave microstrip antenna having a ground plane member and a microstrip element that are generally of the same physical area, and are arranged in a mutually parallel configuration so as to define a dielectric space therebetween. The microstrip element has a length that is approximately one quarter the wavelength of the center frequency at which the antenna operates. Since the antenna is a quarter wave microstrip antenna, the microstrip element includes an L-shaped shorting element by which one edge of the microstrip element is mounted to one edge of the ground plane member by way of four metal screws that establish electrical and mechanical connection between the microstrip element and the ground plane member. A center portion of the microstrip element is cut so that a feed member may be bent downward at generally a right angle; i.e., the feed member is bent in the direction of the ground plane member. A transmission line is held by the above-described four screws and extends into the dielectric space between the microstrip element and the ground plane member. The transmission line includes a first electrical conductor that is connected to the ground plane member and a second electrical conductor that is connected to the feed member of the microstrip element.

U.S. Pat. No. 5,444,453 by Lalezari describes a parallel plate, inverted, microstrip type of antenna using air as a dielectric and intended to operate in the 10 to 40 gigaHertz range. A relatively large dielectric plate (i.e., 1×1 to 2×2 inch square or one to two inch diameter circular plates) supports a smaller metallic radiator patch centrally located over a metallic ground plane member that is about the same size as the dielectric plate. A number of support posts of substantially the same height maintain a 0.1 mm to 1.0 mm spacing between the dielectric plate and the ground plane member.

U.S. Pat. No 5,532,707 to Klinger et al provides a directional dipole antenna wherein four dipole elements and their individual symmetrizer legs are stamped out of the material of a reflector. The four L-shaped dipole/symmetrizer units are then bent upward from the plane of the reflector by an angle of 30 to 60 or 90-degrees. In this way, the plane of the reflector meets the planes of the four L-shaped dipole/symmetrizer units to form a V-shape.

SUMMARY OF THE INVENTION

This invention finds utility in a wide variety of antennas and antenna applications, and is especially useful for the specialized needs of wireless communication equipment, such as for operating in the unlicensed (U.S.A.) 902–928 MHz frequency band. An embodiment of this invention advantageously utilizes a radiating element that is oriented at an angle relative to a ground plane element, as is describe in the above-mentioned related United States Patent.

An antenna in accordance with the spirit and scope of this invention is formed from a single sheet of generally planar metal that is stamped, cut, or formed, and then bent, to provide four functional shapes in one unitary metal assembly.

These four functional shapes comprise a ground plane element, a radiating element that is physically spaced from or above the ground plane element, a two-section shorting element that is joined to the radiating element and to the ground plane element by two generally parallel fold lines, and an arm that has one end fixed to a generally central portion of the radiating element and has a free end that extends toward a shorting element fold line.

Folding or bending this metal sheet on the above-described two fold lines provides that the radiating element may be positioned parallel to, or at an angle to, the ground plane element.

A two-conductor transmit/receive feed line, for example a coaxial cable, is aligned with a gap that is formed in the two-section shorting element. One conductor of this feed line (for example, the outer metal sheath of a coaxial cable) connects to the ground plane element, while a second conductor of the feed line (for example, the center conductor of a coaxial cable), connects to the radiating element and, for example, this second conductor connects to the above-described extending arm that is formed unitary with the radiating element.

As a feature of the invention, and when the transmit/receive feed line comprises a coaxial cable, that cable has an outer metal sheath which is connected to a T-shaped metal connector tab by bending the arms of the T around the cable metal sheath, and then securing the T arms thereto, such as by the use of solder, welding, electrically conductive glue, or the like. The extending leg of this T-shaped connector tab is then secured, or soldered, to the top or bottom surface of the ground plane element, as the cable's center conductor is secured to the top or bottom surface of the radiating element.

Impedance matching of the antenna to the transmit/receive feed line/cable is achieved by a unique construction and arrangement of the above-described arm whose one end is fixed to a generally central portion of the radiating element, and whose free end extends toward a shorting element fold line.

Another embodiment of an antenna in accordance of this invention is formed from a single sheet of generally planar and self-supporting metal (for example, copper) that is stamped, cut, or formed, and then bent, to provide three functional shapes in one unitary metal assembly.

These three functional shapes comprise a generally rectangular and planar ground plane element, a generally rectangular and planar radiating element that is physically spaced from or above the top surface of the ground plane element, and a unitary shorting element that is joined to the radiating element and to the ground plane element by two generally parallel fold lines.

Folding or bending this metal sheet on the above-described two fold lines provides that the bottom surface of the radiating element is spaced from the top surface of the ground plane element by an air dielectric, and the plane of the radiating element may be positioned parallel to, or at an angle to, the plane of the ground plane element.

In an antenna in accordance with this embodiment of the invention, currents that flow in both the radiating element and the ground plane element flow in a direction that is generally perpendicular to the two above-described generally parallel fold lines.

A two conductor transmit/receive feed line, for example a coaxial cable, is provided for this antenna. One conductor of this feed line (for example, the outer metal sheath of a coaxial cable) is soldered to the bottom surface of the ground plane element, while a second conductor of the feed line (for example, the center conductor of a coaxial cable) extends upward through a relatively large size opening that is formed in the ground plane element, and then upward through the air space that separates the ground plane element and the radiating element. This second conductor of the feed line then penetrates a generally matching size hole that is formed in the radiating element, and the second conductor is then soldered to the radiating element.

As will be appreciated, the above-described folded shape unitary metal antenna provides that when one attempts to solder to the ground plane element and/or to the radiating element, as above described, this unitary metal shape acts as a substantial heat sink that inhibits proper soldering thereto. Expensive soldering techniques are known that will operate to overcome heat sink problems of this type. However, in accordance with this embodiment of the invention, a construction and arrangement is provided whereby the above-described soldering operations are accomplished in an economical manner, using only a simple and inexpensive soldering process, such as is provided by the use of a well known automatic soldering iron or a well known hand-held soldering iron.

More specifically, and in accordance with this invention, the ground plane element is stamped or cut so as to form a first soldering area between two generally parallel slots that penetrate the ground plane element, and the radiating element is stamped or cut so as to form a second soldering area between two generally parallel slots that penetrate the radiating element. These slot operate to thermally isolate the first and second soldering areas so that whatever heat sinks remain in both the ground plane element and radiating element, the heat sinks are of a relatively small thermal capacity. As a result, the above-described two soldering operations can easily be accomplished by a hand soldering iron, or its equivalent.

A critical feature of the above-described thermal barrier slot pair construction and arrangement is that the slots must extend parallel to the direction of current flow in both the ground plane element and the radiating element. That is, the slots must extend generally perpendicular to the above described fold lines.

As a feature of this embodiment of the invention, the ground plane element is cut to form a first metal tab that is bent downward out of the plane of the bottom surface of the ground plane element. This first metal tab is then bent back upward in a manner to capture the outer insulating sheath of the above described transmit/receive feed line. This first metal tab, when so bent, operates to physically mount the transmit/receive feed line to the bottom surface of the ground plane element in a strain relief fashion.

As a feature of this embodiment of the invention, the top surface of the ground plane element includes at least one portion over which the radiating element does not overlie, and a device having its own internal antenna is mounted on this portion of the top surface of the ground plane element, such that the ground plane element also provide a ground plane function for this device. An example of such a device is a GPS module wherein the above-described ground plane element also provides a ground plane function for the GPS module.

As another feature of this embodiment of the invention, the above-described device or GPS module includes a wire or cable that extends therefrom, and the ground plane element is cut to form a second metal tab that is bent downward out of the plane of the bottom surface of the ground plane element. This second metal tab is then bent back upward in a manner to capture the outer insulating sheath of the above-mentioned GPS extending wire or cable. This second metal tab, when so bent, operates to physically mount the extending wire or cable to the bottom surface of the ground plane element in a strain relief fashion.

More specifically, the above-mentioned first and/or second metal tabs are formed by stamping or cutting the ground plane element in the form of a first and/or a second U-shaped slot, to thereby define the first and/or second metal tabs. In accordance with this embodiment of the invention, the base portion of the first and/or second U-shape slot is of relatively short dimension and extends generally parallel to the above-mentioned fold lines, whereas the two relatively longer and parallel legs of the first and/or second U-shaped slot extend generally perpendicular to the above-described fold lines, and thus parallel to the direction of current flow in the ground plane element.

In summary, this embodiment of the invention wherein a single sheet of generally planar and self-supporting metal is formed to provide three functional shapes in one unitary metal assembly, provides for the thermal isolation of the soldering attachments for a coaxial cable's coaxial braid and center feed conductor by the use of relatively long and narrow slots on both sides of the radiating patch area and the ground plane area that are used for soldering.

The slots are oriented in the direction of the main currents that flow in the radiating patch and the ground plane, thereby eliminating the deleterious effects which are caused when the flow of these currents is disrupted.

Use of these thermal isolation slots allows electrical and mechanical attachment of a variety of coaxial cable types, making the patch antennas of the invention useful for broad applications, especially mobile applications where small and flexible coaxial cables are preferred, to thereby permit retrofit installation of the patch antenna in commercial and passenger vehicles, without the need for significant modifications to the vehicles, and without the need for extensive installation time.

Prior to the present invention, the large heat sink behavior of copper patch antennas made the connection of arbitrarily small coaxial cables thereto difficult and/or expensive, or required an additional connector component, thereby adding cost and complexity to the antenna assembly.

This embodiment of the invention desirably provides that the coaxial cable is terminated at the antenna while the coaxial cable extends parallel to the antenna's ground plane, whereas the antenna's radiating patch is feed vertically, this being compared to a convention construction wherein the coaxial cable extends perpendicular to the antenna's ground plane.

This embodiment of the invention also integrates a cable mechanical strain relief(s) directly into the antenna's ground plane, wherein the ground plane's strain relief mounting tabs are oriented in the direction of current flow, thereby again eliminating the deleterious effects which are caused by disruption of these currents.

This and other embodiments of the invention also use the ground plane of a ¼ wavelength patch antenna as the ground plane of a second antenna system, such as a GPS antenna that is used for location determination.

Those having normal skill in the art will recognize the foregoing and other objects, features, advantages and applications of the present invention from the following more detailed description of the preferred embodiments as illustrated in the accompanying drawings.

BRIEF DESCRIPTION OF THE DRAWINGS

FIG. 3 is a side view of the quarter wave antenna of FIG. 2 showing that in this particular antenna, the FIG. 1 metal sheet has been folded so as to provide that the radiating element is inclined relative to the ground plane element while

FIG. 3A is an isometric view of the antenna shown in FIGS. 2 and 3.

DESCRIPTION OF THE PREFERRED EMBODIMENT

A microstrip antenna in accordance with the present invention has a minimum number of parts, has a lower cost, has better reliability, has a higher gain, has an increased bandwidth, and has a lower weight, as compared to contemporary antennas.

Figure 1:
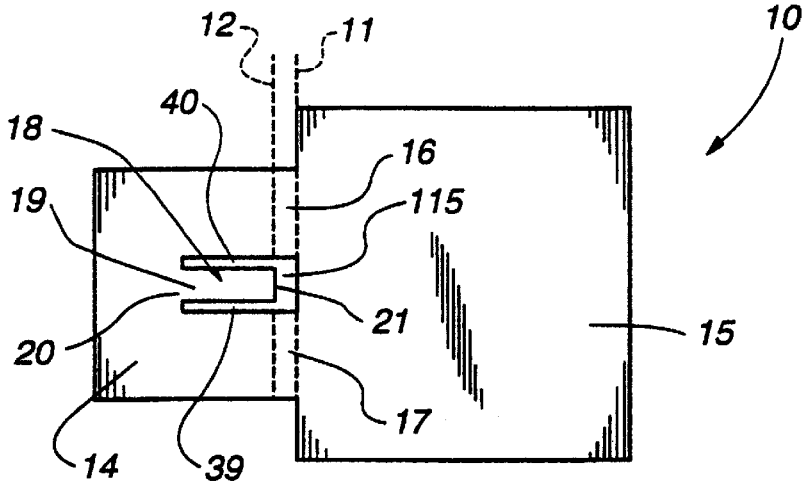
FIG. 1 is a top view of a flat sheet of metal, for example copper, that has been stamped, cut, or formed to provide four functional shapes of an antenna in accordance with this invention within one unitary metal assembly, and wherein two parallel and dotted lines define two fold lines.

FIG. 1 is a top plan view of a flat sheet 10 of a metal, such as copper, but without limitation thereto, that is about 1/64 inch thick and has been stamped, cut, or formed to provide four functional shapes of an antenna in accordance with this invention within the one unitary metal sheet 10.

In FIG. 1, two parallel dotted lines 11, 12 define two fold lines about sheet 10 is bent or folded to a generally U-shape, as will be described.

Figure 2:
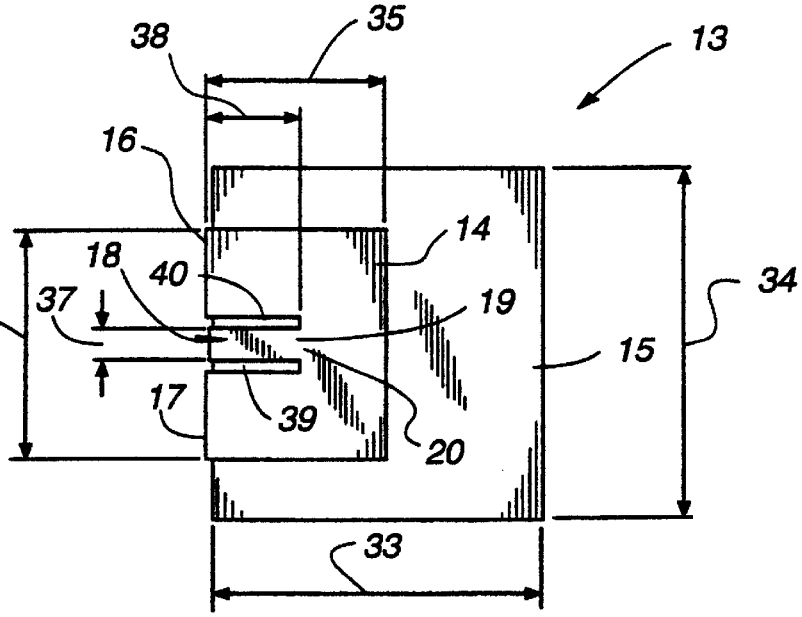
FIG. 2 is a top view of a quarter wave antenna that is formed by folding the FIG. 1 metal sheet along the two fold lines.
Figure 3:
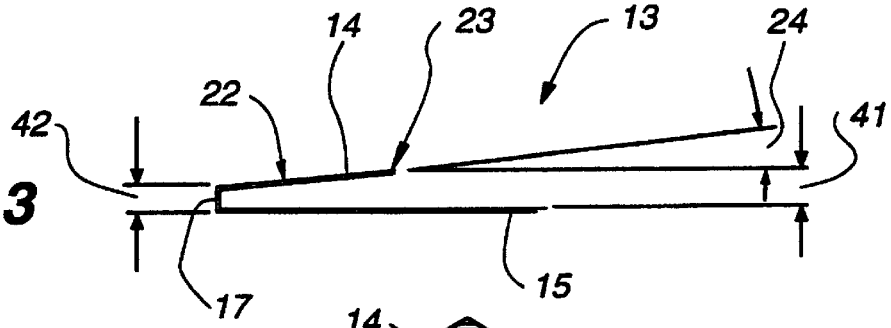

When metal sheet 10 is folded about fold lines 11, 12, the result is the antenna configuration shown in FIGS. 2 and 3. More specifically, FIG. 2 is a top view of a quarter wave antenna 13 that is formed by folding the FIG. 1 metal sheet 10 along the two fold lines 11, 12 to form what can be generally characterized as a U-shape. FIG. 3 is a side view of the quarter wave antenna 13 of FIG. 2.

While the present invention is not to be limited thereto, this invention finds utility where metal sheet 10 has been folded about fold lines 11,12 so as to provide that the antenna's radiating element 14 is inclined relative to the antenna's ground plane element 15.

Figure 7:
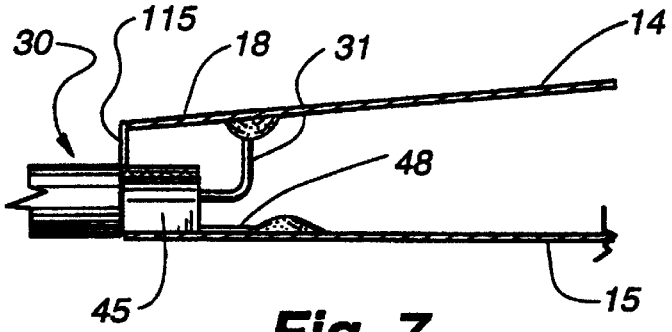
FIG. 7 is an enlarged and partially cutaway side view showing the assembly of FIGS. 5 and 6 soldered in place relative to the quarter wave antenna of FIGS. 2 and 3, and more specifically, the T-shaped metal conductor tab is soldered to the antenna's ground plane element and the cable's center conductor is soldered to the antenna's radiating element arm.
Figure 10:
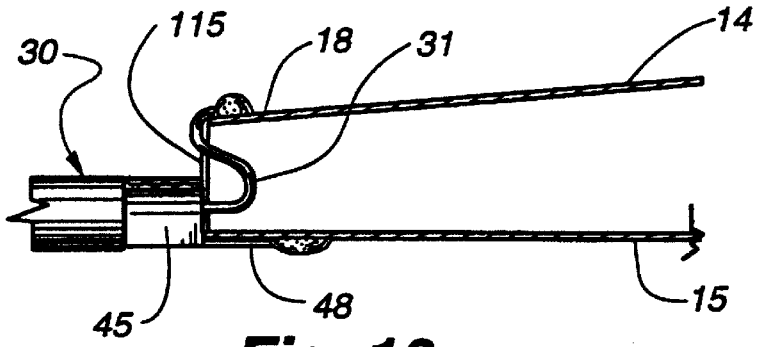
FIG. 10 is a view similar to FIG. 7, but FIG. 10 shows how the T-shaped metal conductor tab is soldered to the bottom surface of the antenna's ground plane element and how the cable's center conductor is soldered to the top surface of the antenna's radiating element arm.

In making an antenna 13, as shown in FIGS. 2 and 3, a flat metal sheet is formed so as to provide a unitary sheet 10 having a ground plane portion 15, a radiating portion 14, a first and second generally parallel, generally equal length, and physically spaced connecting portions 16/17 that connect ground plane portion 15 to radiating portion 14, and an extending tab 18 that extends from a generally central location of radiating element 14 in a direction toward ground plane portion 15, extending tab 18 having a free end 21 that is spaced from ground plane portion 15, to thereby define a gap 115 between the free end 21 of extending tab 18 and ground plane portion 15. As will be apparent, once the thus formed sheet 10 is bent, as shown in FIGS. 2, 3, 7, and 10, gap 115 provides for entry of a coaxial cable 30, as shown in FIGS. 7 and 10.

It should be noted that first and second connecting portions 16 and 17 having opposite ends that define two generally parallel fold lines 11/12, and that folding metal sheet 10 about these two generally parallel fold lines 11/12, so as to physically position radiating portion 14 and extending tab 18 over ground plane portion 15, places gap 115 in an operative position generally between ground plane portion 15 and radiating portion 14.

As shown by FIGS. 1–3, an antenna 13 in accordance with the spirit and scope of this invention is formed of a single sheet of generally planar metal 10 that is stamped, cut, or formed, and then bent, to provide four functional shapes in one unitary metal assembly. These four functional shapes comprise a ground plane element 15, a radiating element 14 that is physically spaced from, or above, radiating element 14, a two-section shorting element 16/17 that physically joins radiating element 14 and ground plane element 15 at the two generally parallel fold lines 11/12, and an arm 18 that has one fixed end 19 unitary with a generally central portion 20 of the radiating element 14, and has a free end 21 that extends toward, and generally terminates at, fold line 12.

While antenna 13 of FIGS. 2 and 3 has been shown as a quarter wave antenna, the spirit and scope of the present invention is not to be limited thereto. In addition, while radiating element 14 is shown as being of a smaller planar or physical size than ground plane element 15, it is within the spirit and scope of this invention to provide other radiator/ground plane size relationships.

Within antenna 13, radiating element 14 is oriented in a converging (i.e.,: non-parallel relation) to ground plane element 15. This non-parallelism allows the designer to match the impedance of antenna 13 to the antenna feed in/feed out cable (shown in FIGS. 5–9) very accurately and in a single piece construction.

Typically, the bandwidth of a microstrip antenna can be increased by increasing the dielectric space between radiating element 14 and ground plane element 15. Unfortunately, as this space increases, the antenna's feed inductance also increases. A mismatch between the antenna's impedance and the antenna's feed-in/feed-out conductor/cable causes a portion of the power applied to the antenna to be reflected back to the source, rather than being radiated into free space as desired, thus reducing the gain of the antenna.

This invention allows a designer to increase the antenna bandwidth without increasing the antenna feed impedance, a typical impedance being about 50 ohms. As a result, the antenna radiating power does not suffer. Bending metal sheet 10 about bend lines 11,12, so that radiating element 14 is placed in a non-coplanar position above ground plane element 15, as is best seen in FIG. 3, reduces the antenna feed inductance that is normally caused by elevating radiating element 14 above ground plane element 15. The incline of radiating element 14 is selected so as to result in a near ideal standing wave ratio (VSWR) of 1:1. A typical antenna in accordance with this invention provides nearly an ideal match, with nearly zero power reflected due to impedance mismatch.

As shown in FIG. 3, radiating element 14 is tilted so that its feed side 22 adjacent to fold line 11 is closer to ground plane element 15 than is the far side 23 of radiating element 14. The angle of tilt 24 of radiating element 14 relative to ground plane element 15 can range from a few degrees to nearly 90-degrees, wherein element 14 is essentially perpendicular to ground plane element 15. The greater tilt angle 24, the greater the bandwidth.

Figure 5:
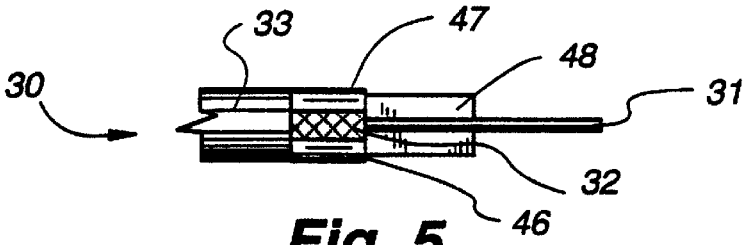
FIG. 5 is a top view of the T-shaped metal connector tab of FIG. 4, wherein the two T arms have been bent upward about the two fold lines, wherein the metal sheath of a coaxial cable has been placed between the two upward-extending T arms, and wherein the two T arms have been bent downward around the cable's metal sheath, whereby the T-shaped metal conductor tab is clamped to the cable's metal sheath, and then soldered in place.
Figure 6:
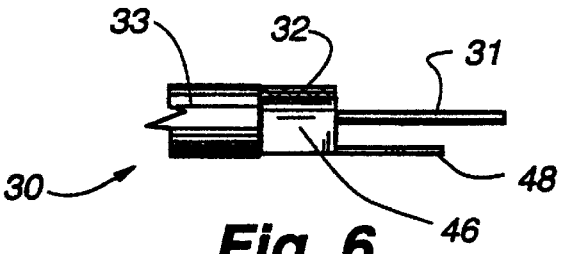
FIG. 6 is a side view of the assembly of FIG. 5.
Figure 8:
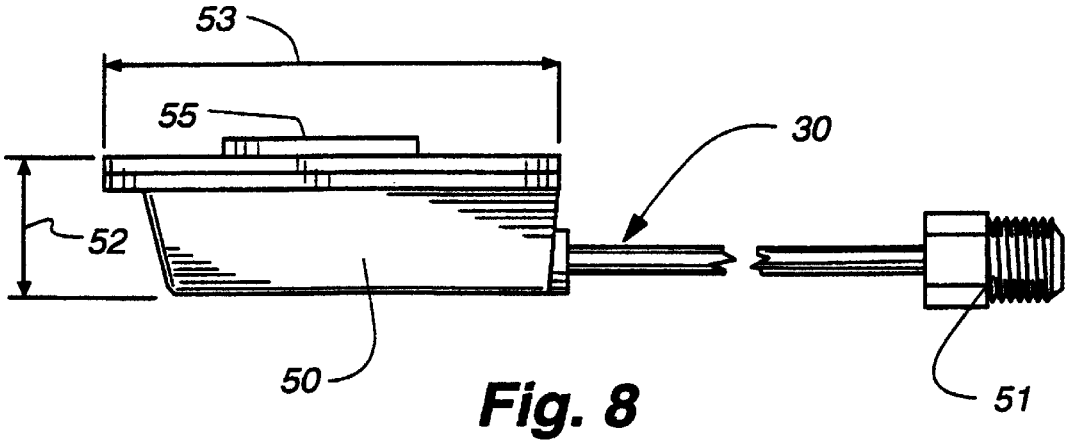
FIG. 8 is a side view of the assembly of FIG. 7, wherein a plastic radome is mounted onto the peripheral edges of the antenna's ground plane element, this view also showing a connector that is located on an end of the cable that is opposite to the antenna.
Figure 9:
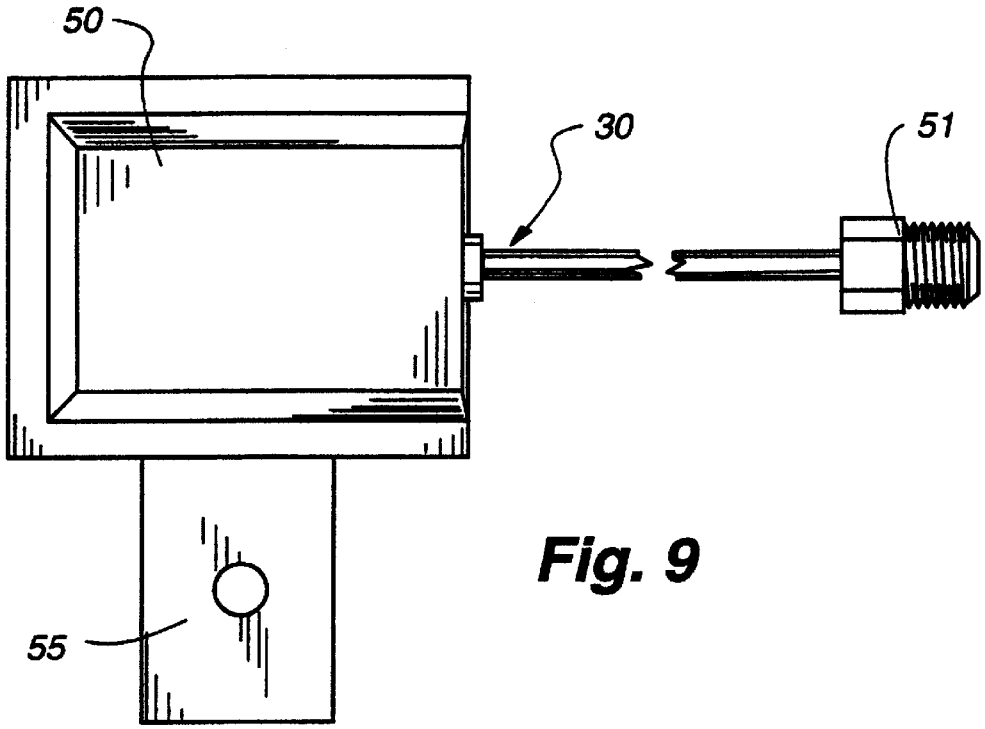
FIG. 9 is a top view of the assembly of FIG. 8, this view also showing a side-disposed assembly mounting tab.

The components of a completed antenna in accordance with this invention consist of (1) a unitary antenna 13 as shown in FIG. 3, (2) a feed in/feed out conductor, such as coaxial cable 30 shown in FIGS. 5, 6 and 7 having a center conductor 31, and a wire mesh sleeve or sheath 32, and (3) a radome as shown in FIGS. 8 and 9. As is conventional, an insulator sleeve 33 encases the outer periphery of cable 30, and another insulator sleeve separates inner conductor 31 from sheath 32.

While the dimensions of antenna 13 are not considered to be critical to the broader spirit and scope of this invention, in an embodiment of this invention dimension 33 (see FIG. 2) was about 1.920-inch, dimension 34 was about 2.000-inch, dimension 35 was about 1.130 inch, dimension 36 was about 1.310, dimension 37 was about 0.200-inch, dimension 38 was about 0.600-inch, and the width of the two slots that form arm 18 was about 0.0600-inch. With reference to FIG. 3, dimension 41 was about 0.250-inch, and dimension 42 was about 0.160-inch.

Embodiments of this invention included antennas operating at about 1800 MHz and about 1900 MHz whose volume dimensions were about 2.50-inch by 2.50-inch by 0.75-inch, and an antenna operating at about 2400 MHz whose volume dimensions were about 2.00-inch by 2.25-inch by 0.40-inch.

In an embodiment of this invention, arm 18 extended coplanar with radiation element 14, as shown in FIG. 3. However, it is to be noted that the spirit and scope of this invention is not to be limited to this coplanar relationship. In fact, bending arm 18 out of this coplanar relationship can be instrumental in obtaining a desired impedance match.

Figure 4:
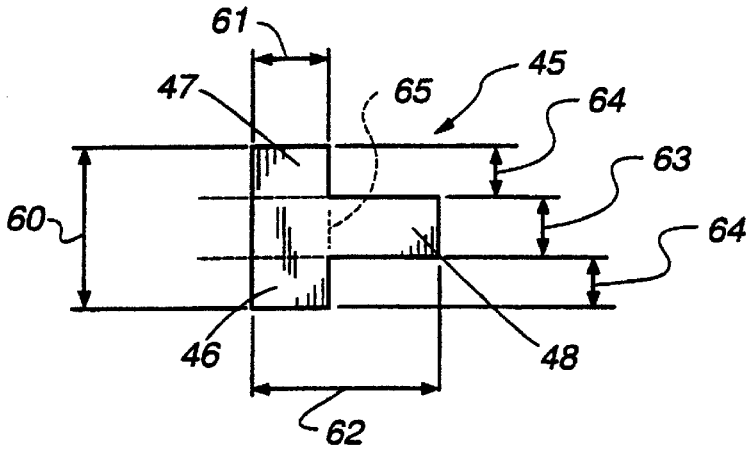
FIG. 4 is a top view of a T-shaped metal connector tab in accordance with the invention, wherein two parallel dotted lines define two fold lines.
Figure 4A:
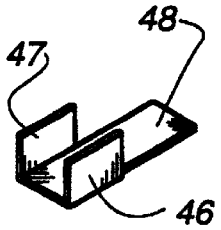
FIG. 4A is an isometric view of FIG. 4 with the ears bent to receive a coaxial cable.

As a feature of this invention, when the antenna transmit/receive feed line comprises a coaxial cable 30, a flat T-shaped metal, preferably copper, connector tab 45 is provided as shown in FIG. 4. In this construction and arrangement, the cable's outer metal sheath 32 is connected to connector tab 45 by bending the two T arms 46, 47 of the T-shape around metal sheath 32, and then securing connector tab 45 to sheath 32, preferably both by a clamping action and by the use of solder or the like, this being shown in FIGS. 5 and 6.

As perhaps best seen in FIG. 6, the extending leg 48 of T-shaped connector tab 45 is now available for securing (such as by soldering, welding, mechanical connection, etc.) to the top surface or to the bottom surface of ground plane element 15, as the cable's center conductor 31 is available for securing to the top surface or to the bottom surface of arm 18 that is formed integrally with radiating element 14. Note that tab 45 can be omitted by cutting U-shaped grooves in ground plane element 15 and bending the two ears thus defined into contact with the cable 30 metal sheath 32 thereby providing electrical connections similar to arms 46 and 47. This could facilitate attachment to element 15 by welding, soldering or the like.

With reference to FIG. 4, in an embodiment of the invention, but without limitation thereto, dimension 60 of T-shaped connector tab 45 was about 0.50-inch, dimension 61 was about 0.25-inch, dimension 62 was about 0.55-inch, dimension 63 was about 0.18-inch, dimensions 64 were each about 0.16-inch, and the extending leg 48 of T-shaped connector tab 45 was bent downward about dotted line 65 about 0.025-inch, such that leg 48 extended generally parallel to the unbent plane of arms 46/47.

FIG. 7 is an enlarged and partially cutaway side view showing the assembly of FIGS. 5 and 6 soldered in place relative to the quarter wave antenna of FIGS. 2 and 3. More specifically, the extending leg 48 of T-shaped connector tab 45 is soldered to the top surface of the antenna's ground plane element 15 and the cable's center conductor 31 is soldered to the bottom surface of the arm 18 that is formed integrally with the antenna's radiating element 14.

FIG. 10 is a view similar to FIG. 7, but FIG. 10 shows how the extending leg 48 of the T-shaped metal connector tab 45 is soldered to the bottom surface of antenna's ground plane element 15, whereas the cable's center conductor 31 is soldered to the top surface of the arm 18 that is formed integrally with antenna's radiating element 14.

FIG. 8 is a side view of the assembly of FIG. 7, wherein a plastic radome 50 is mounted onto the peripheral edges of the antenna's ground plane element 15. FIG. 8 also shows an electrical connector 51 that is located on the end of cable 30 that is opposite to radome 50. In an embodiment of the invention, but without limitation thereto, dimension 52 was about 0.56-inch, dimension 53 was about 2.21-inch, and cable 30 was about 12 feet long.

FIG. 9 is a top view of the assembly of FIG. 8. This view also shows a side disposed plastic mounting tab 55 that is used to mount the antenna/radome combination in an operating position.

Figure 14:
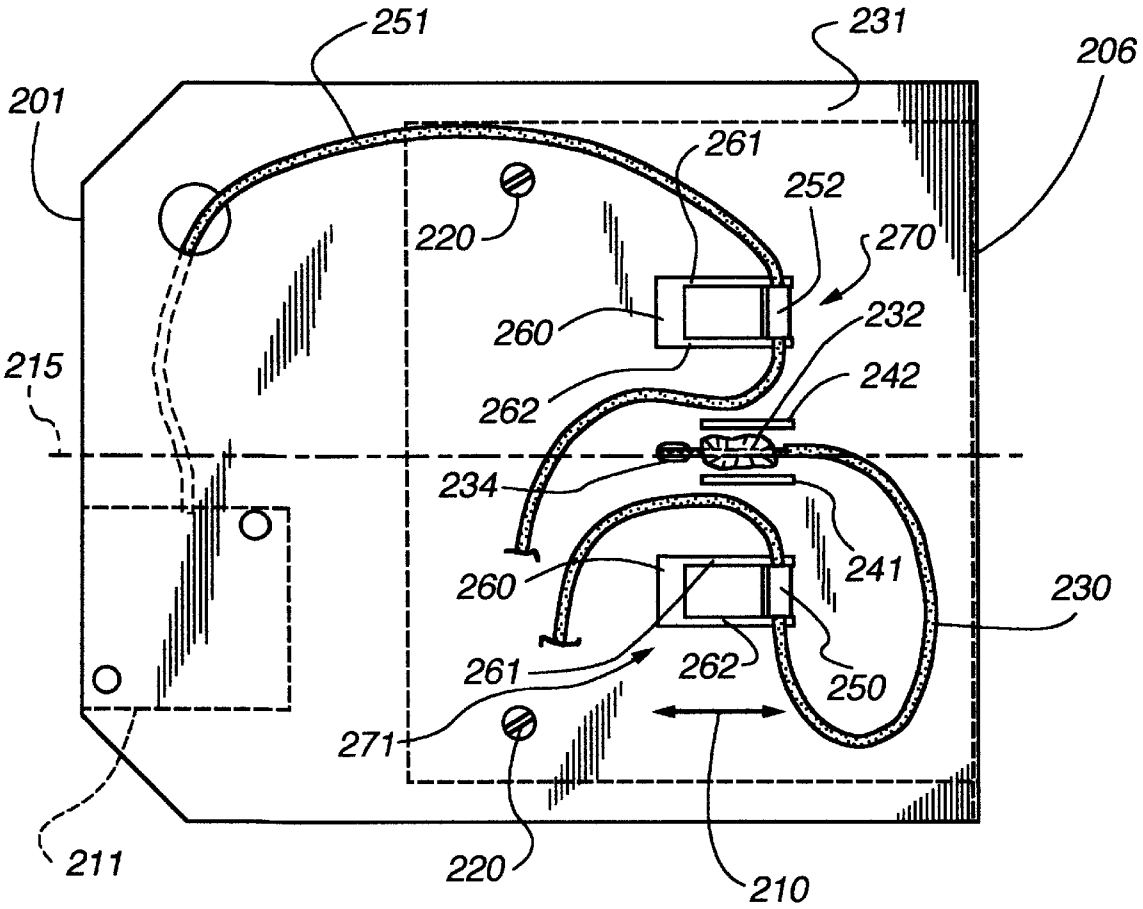
FIG. 14 is a bottom view of the antenna of FIG. 11, this figure showing a pair of parallel slots that are cut or stamped into the ground plane element and that extend generally normal to a fold line of the ground plane element, these two physically spaced slots operating to define a heat isolated area for use in soldering a second conductor of the transmit/receive feed line, for example the outer metal sheath of the coaxial cable, to the bottom surface of the ground plane element, this figure showing two U-shaped slots that are cut or stamped into the ground plane element so as to provide two bent metal tabs that serve to mount the transmit/receive feed line and a cable that extends from the GPS module to the bottom side of the ground plane element in strain relief fashions, these two U-shaped slots having a relatively short dimension base portion that extends generally parallel to the ground plane element's fold line, and these two U-shaped slots each having two parallel and relatively long dimension leg portions that extend perpendicular to this fold line.
Figure 15:
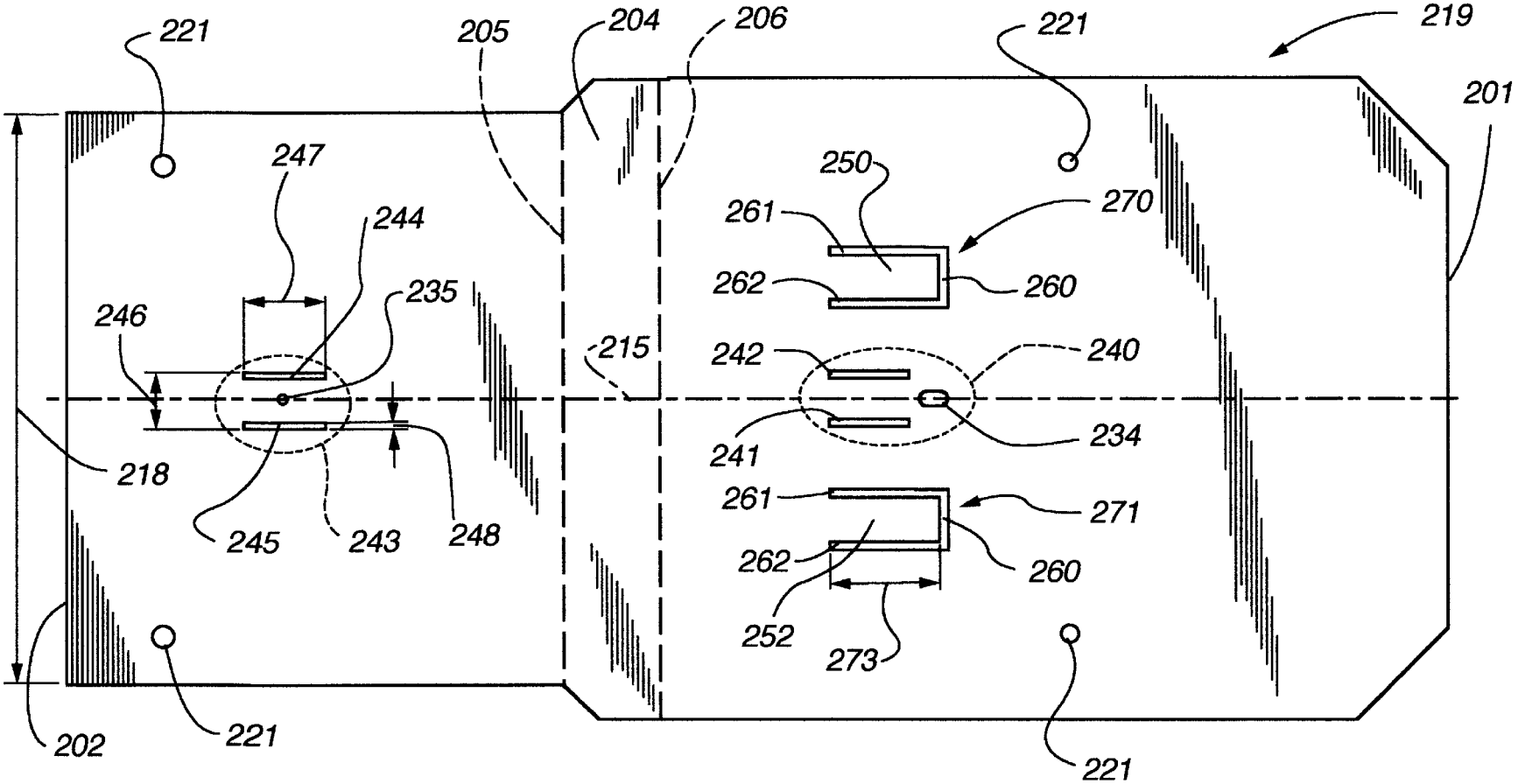
FIG. 15 is a top view of a flat and stamped metal sheet out of which the antenna of FIG. 11 is formed by folding the flat metal sheet.

FIGS. 11–14 show an embodiment of an antenna 200 in accordance with an embodiment of this invention wherein antenna 200 is formed by folding a single flat sheet of generally planar and self-supporting metal (for example a sheet 219 of copper as seen in FIG. 15) that has been stamped, punched or cut. Flat sheet 219 of FIG. 15 is bent about lines 205,206 to provide three functional shapes in one unitary metal assembly 200. These three functional shapes comprise a generally rectangular, relatively larger, and planar ground plane element 201, a generally rectangular, relatively smaller, and planar radiating element 202 that is physically spaced from or above a portion of the top surface 203 of ground plane element 201, and a shorting element 204 that is integrally joined to one edge of radiating element 202 and to a mating edge of ground plane element 204 by two generally parallel fold lines 205 and 206.

Figure 16:
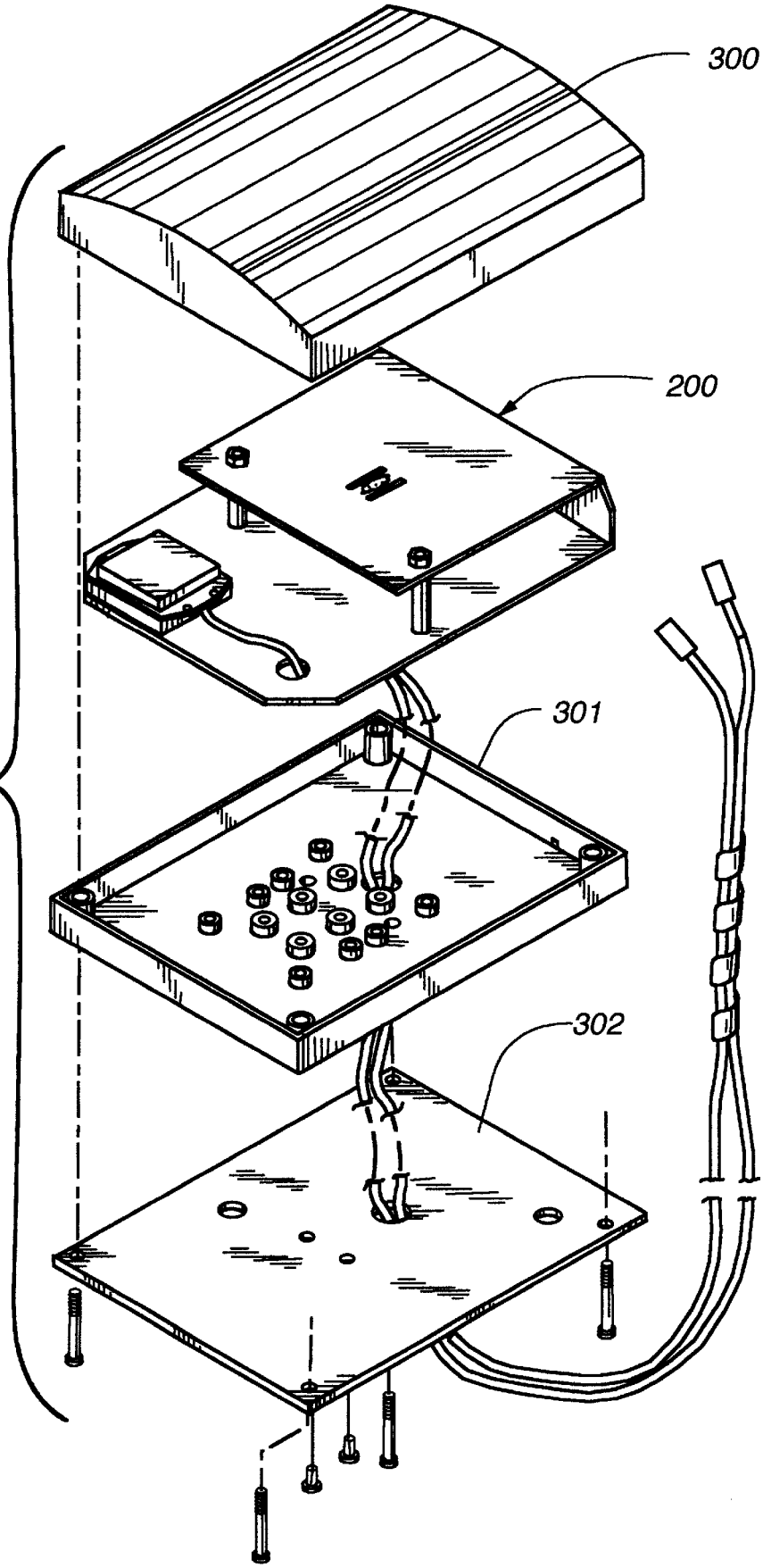
FIG. 16 is an exploded view of the antenna of FIG. 11, this figure also showing a radome and mounting base that may be used with the antenna.

Preferably, antenna 200 is contained within a radome (not shown), for example a radome of the type that is taught by copending PCT Patent Application PCT/US97/05716, filed Apr. 8, 1997, and specifying the United States as a continuation in part application. FIG. 16 provides an exploded view of a radome 300,301 and its mounting base 302 that may be used with antenna 200.

Without limitation thereto, an antenna of the type shown may operate in a frequency range of from about 824 to about 896 MHz, other antennas of this type operating from about 700 MHz to about 3000 MHz. An example of metal used to make the antenna is a smooth surface sheet of 99% pure copper having a thickness of about 0.021 inch. While copper is useful due to its high electrical conductivity, within the spirit and scope of the invention other metals can be used.

Figure 11:
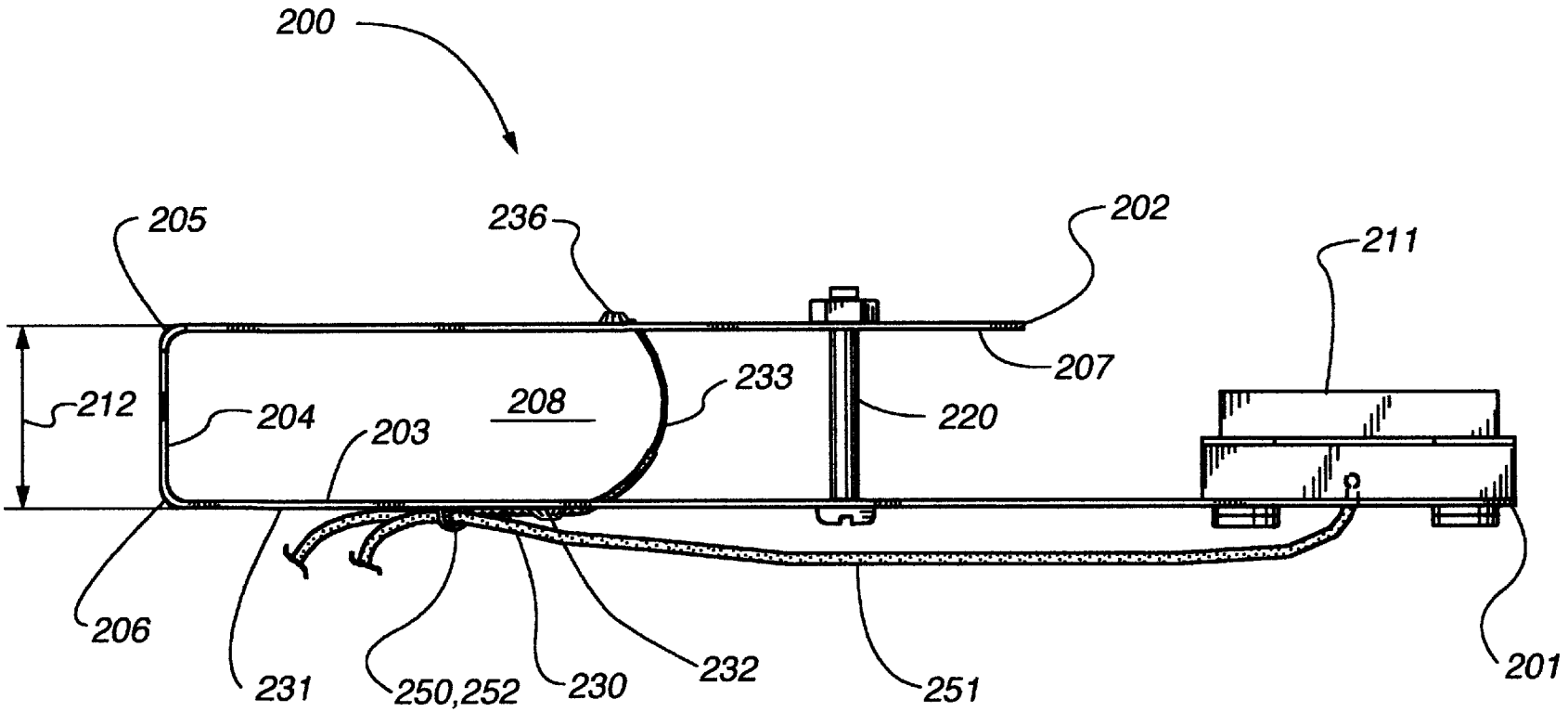
FIG. 11 is a side view of a wide band antenna in accordance with an embodiment of the invention wherein the antenna is formed of a single piece of self-supporting metal that is folded on two parallel fold lines, thereby forming a top-disposed radiating element and a bottom-disposed ground plane element having an air dielectric therebetween, the radiating element and the ground plane element being generally planar elements that extend parallel to one another or that are tilted to one another, and the ground plane element and radiating element being connected by an integral metal shorting element that extends generally normal to a plane occupied by the ground plane element and a plane occupied by the radiating element.

Folding or bending of metal sheet 219 of FIG. 15 on the two fold lines 205,206 provides a unitary antenna 200 that is generally U-shaped when viewed from the side as seen in FIG. 11. The bottom surface 207 of radiating element 202 is vertically spaced from the top surface 203 of ground plane element 201 to define an air dielectric that is designated by numeral 208. The plane that is defined by radiating element 202 may be parallel to the plane that is defined by ground plane element 201, or these two planes may be tilted one to the other as taught by U.S. Pat. No. 5,734,350.

Two dielectric plastic posts 220 are provided to tie or join the cantilevered ends of radiating element 202 and ground plane element 201 together. Posts 220 are secured in holes 221 that are stamped or punched into ground plane element 201 and radiating element 202, these holes being shown in FIG. 15. If desired, posts 220 may be adjustable in length in order to provided for the fine tuning of the vertical spacing between radiating element 202 and ground plane element 201.

Figure 12:
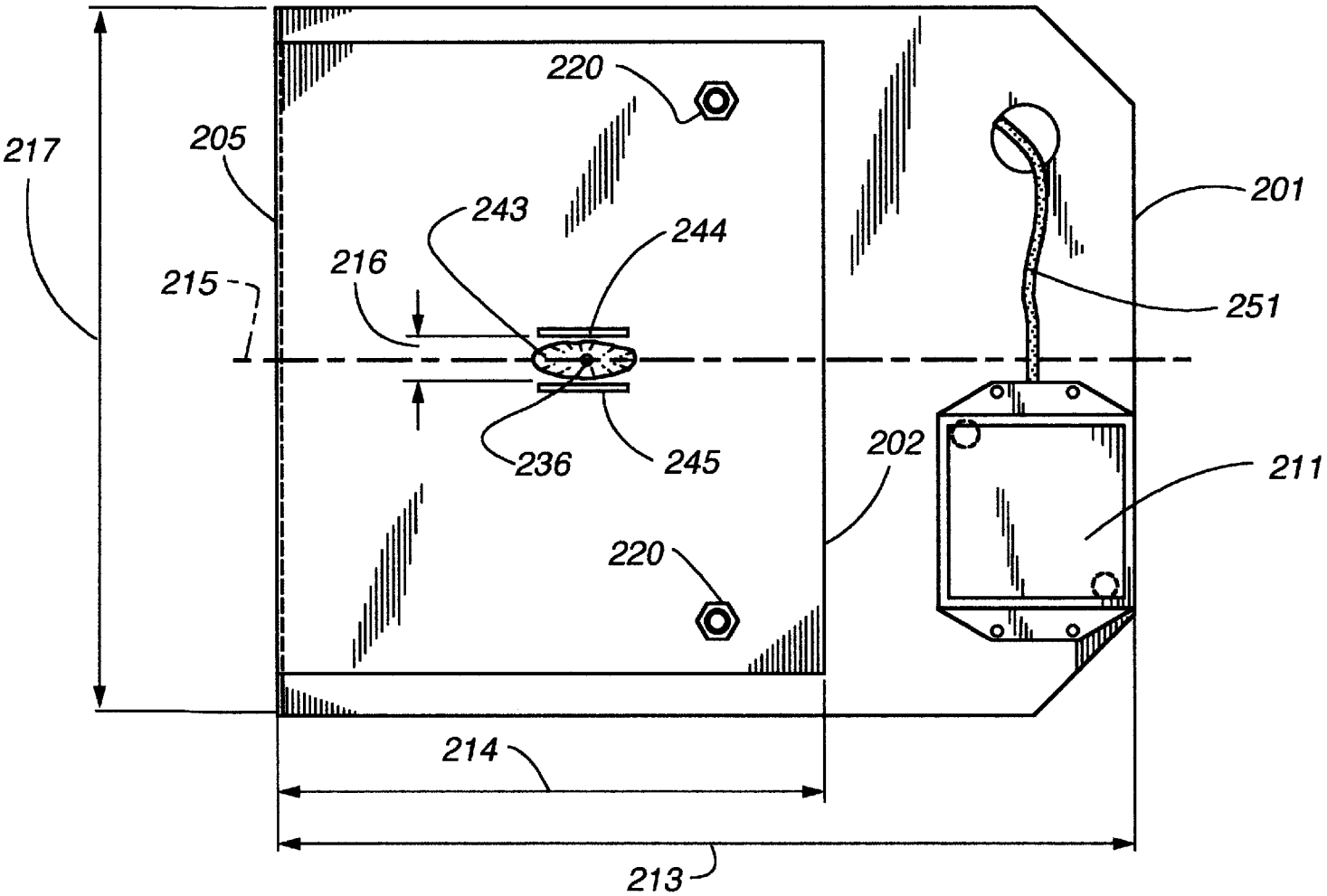
FIG. 12 is a top view of the antenna of FIG. 11, this figure showing the generally rectangular shape of both the relatively smaller radiating element and the relatively larger ground plane element, this figure showing a pair of parallel slots that are cut or stamped into the radiating element and that extend generally normal to a fold line of the radiating element, these two physically spaced slots operating to define a heat isolated area for use in soldering one conductor of a transmit/receive feed line, for example the center conductor of a coaxial cable, to the top surface of the radiating element, and this figure also showing a GPS module that is mounted to a portion of the top surface of the ground plane element over which the radiating element does not extend or overlie.
Figure 13:
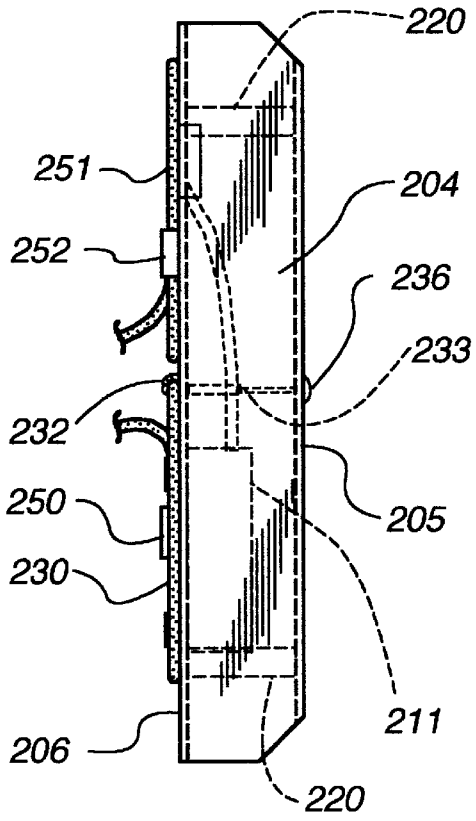
FIG. 13 is a left hand end view of the antenna of FIG. 11, this figure best showing the generally rectangular shape of the antenna's shorting element.

As is well known, when antenna 200 operates as either a receiving antenna a transmitting antenna, electrical currents flow in both radiating element 202 and ground plane element 201 flow in a direction that is generally perpendicular to fold lines 205,206, which electrical currents are represented by arrows 209 and 210 in FIGS. 12 and 14 respectively.

FIG. 11 shows a GPS module 211 of conventional construction that includes its own internal antenna radiating element (not shown). GPS module 211 is physically mounted to the top surface 203 of ground plane element 201 at a portion of this top surface that is not physically covered by radiating element 202. In accordance with a feature of the invention, ground plane element 201 also provides a ground plane function for the antenna that is internal of GPS module 211.

As stated above, in a non-limiting example, antenna 200 comprised a linear quarter wave patch antenna and operated in the frequency range 824 to 896 MHz. The antenna's height dimension 212 of FIG. 11 was about 0.680 inch; the length of ground plane element 201, i.e. dimension 213 of FIG. 12, was about 4.826 inch; the width 217 of ground plane element 201, centered on centerline 215, was about 3.940 inch, the length 214 of radiating element 202 was about 3.075 inch, and the width 218 (see FIG. 15) of radiating element 202, again centered on centerline 215, was about 3.500 inch.

A two conductor transmit/receive feed line, for example coaxial cable 230 is provided, for antenna 200. One of the two metal conductors of this feed line, and more specifically the outer metal sheath of coaxial cable 230, is soldered at 232 to the bottom surface 231 of ground plane element. The second metal conductor of this feed line, and more specifically the center conductor 233 of coaxial cable 230, extends upward through a relatively large size opening 234 (see FIG. 15) that is formed in ground plane element 201. Conductor 233 then extends through dielectric air space 208 that separates ground plane element 201 and radiating element 202. Preferably this extending portion of center conductor 233 carries an insulating coating so as to ensure that conductor 233 does not electrically contact ground plane element 201.

The metal end of second metal conductor 233 of the feed line penetrates a generally matching size hole 235 (see FIG. 15) that is formed in radiating element 202. The metal end of conductor 233 is then soldered at 236 to radiating element 202.

As will be appreciated, the above described folded and unitary metal antenna 200 provides that when one attempts to solder at 232 to ground plane element 201 and at 236 to radiating element 202, as above described, the unitary metal shape acts as a substantial heat sink acts to inhibit proper soldering thereto.

In order to overcome this problem, and without resorting to expensive soldering techniques that might overcome a heat sink problem of this type, this invention provides a construction and arrangement whereby the above described two soldering operations 232 and 236 are accomplished in an economical manner, using only a simple and inexpensive soldering process, such as is provided by the use of a well known automatic soldering iron or a well known hand-held soldering iron.

More specifically, and in accordance with this invention, ground plane element 201 is stamped, punched or cut so as to form a first soldering area 240 (see FIGS. 14 and 15) that includes two generally parallel slots 241, 242 that penetrate completely through ground plane element 201.

Figure 3A:
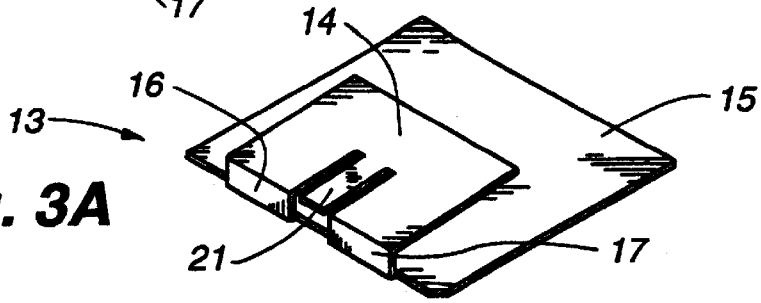
FIG. 3A is an isometric view of the FIGS. 1–3 antenna.

In addition, radiating element 202 is stamped, punched or cut so as to form a second soldering area 243 (see FIGS. 12 and 15) that includes two generally parallel slots 244, 245 that penetrate completely through radiating element 202. Note that extending tab 18, shown for example in FIGS. 1, 2 and 3A is the functional equivalent of second soldering area 243.

Through slot pairs 240, 241 and 244, 245 operate to thermally isolate first and second soldering areas 240, 241 so that the heat sink that remains at areas 240, 241 is of a relatively small thermal capacity. As a result, the above described two soldering operations 232 and 236 are easily be accomplished within areas 240, 241 by the use of a hand soldering iron, or its equivalent.

In an embodiment of the invention, through slot pairs 240, 241 and 244, 245 were separated by a distance 246 of 0.50 inch (see FIG. 15), and the slots had a length 247 of 0.500 inches and a slot width 248 of 0.045 inch.

A feature of the above described thermal barrier slot construction and arrangement is that the four through slots 240, 241, 244, 245 extend parallel to the direction of current flow in both ground plane element 201 and radiating element 202. That is, slots 240, 241, 244, 245 extend generally perpendicular to the above described fold lines 205, 206.

In order to provide for the strain relief mounting of coaxial cable 230, ground plane element 201 is stamped, punched or cut to form a first metal tab 250. Tab 250 is first bent downward out of the plane of the bottom surface 231 the ground plane element 201. First metal tab 250 is then bent back upward in a manner to form a first resilient clip into which coaxial cable 230 is positioned, so as to capture the outer insulating sheath of coaxial cable 230, as is best seen in FIG. 11. First metal tab 250, when so bent, operates to physically mount coaxial cable 230 to the bottom surface 231 of ground plane element 201 in a strain relief fashion.

GPS module 211 includes a wire or cable 251 that extends therefrom. Ground plane element 201 is also stamped, punched or cut to form a second metal tab 252 that is bent downward out of the plane of the bottom surface 231 of ground plane element 201. This second metal tab 252 is then bent back upward in a manner to form a second resilient clip into which wire/cable 251 is positioned, so as to capture the outer insulating sheath of wire/cable 251, as is best seen in FIG. 11. Second metal tab 252, when so bent, operates to physically mount extending wire/cable 251 to the bottom surface 231 of ground plane element 201 in a strain relief fashion.

As best seen in FIGS. 14 and 15, above mentioned first and second metal tabs 250, 252 extend as an integral part of metal ground plane element 201, and the two tabs are formed by a first and a second U shaped through slot 270, 271 that completely penetrate ground plane element 201, and that respectively define the three orthogonal sides of metal tabs 250, 252.

In accordance with the invention, the base portion 260 of each U-shape slot 270, 271 is of relatively short dimension (for example 0.30 inches long) and extends generally parallel to the above mentioned two fold lines 205, 206, whereas the two relatively longer and parallel legs 261, 262 of each U-shaped slot 270, 271 extend generally perpendicular to fold lines 205, 206. Thus, slot legs 262, 262 extend parallel to the direction of current flow (see current flow arrow 210 in FIG. 14) in ground plane element 201.

By way of a non-limiting example, U-shaped slots 270, 271 are about 0.045 inch wide, the length 273 of slot legs 261, 262 is about 0.70 inch, and slot legs 261,262 are separated by a distance 274 of about 0.28 inch.

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. A method of making an antenna having a ground plane element and a radiating element that physically overhangs said ground plane element, comprising the steps of:

providing a flat metal sheet;

forming said flat metal sheet to provide a ground plane element, a radiating element, and a shorting element that is physically located intermediate said ground plane element and said radiating element;

said shorting element being physically connected to said ground plane element at a first linear fold line area, and said shorting element being physically connected to said radiating element at a second linear fold line area that is generally parallel to said first linear fold line area;

forming a first pair of generally linear, side-aligned, and physically spaced through-slots in said radiating element;

said first pair of through-slots extending normal to said first and second linear fold line areas;

said first pair of through-slots defining a first soldering area on a portion of said radiating element between said first pair of through-slots;

bending said flat metal sheet on said fold line areas so as to physically position said radiating element over said ground plane element;

said radiating element and said ground plane element having a dielectric layer therebetween;

providing a first insulated cable containing a first and a second metal conductor;

soldering said first conductor to said first soldering area; and connecting said second conductor to said ground plane element.

2. The method of claim 1 including the steps of:

forming a first U-shaped through-slot in said ground plane element, to thereby form a first metal tab in said ground plane element;

said first U-shaped through-slot having a relatively shorter dimension base portion that extends generally parallel to said fold line areas, and said first U-shaped through-slot having two parallel and relatively longer leg portions that extend generally normal to said fold line areas;

bending said first metal tab downward and away from a bottom surface of said ground plane element;

positioning said first cable adjacent to said bottom surface of said ground plane element and adjacent to said bend down first metal tab; and bending said bend down first metal tab upward toward the bottom surface of said ground plane element, to thereby physically trap said first cable against said bottom surface of said ground plane element.

3. The method of claim 2 wherein a portion of said ground plane element is free of overhang by said radiating element, and including the steps of:

providing an device having an antenna and having a second cable extending from said device;

mounting said device on said portion of said ground plane element, such that said ground plane element provides a ground plane element for said device;

forming a second U-shaped through-slot in said ground plane element, to thereby form a second metal tab in said ground plane element;

said second U-shaped through-slot having a relatively shorter dimension base portion that extends generally parallel to said fold line areas, and said second U-shaped through-slot having two parallel and relatively longer leg portions that extend generally normal to said fold line areas;

bending said second metal tab downward and away from the bottom surface of said ground plane element;

positioning said second cable adjacent to the bottom surface of said ground plane element and adjacent to said bend down second metal tab; and bending said bend down second metal tab upward toward the bottom surface of said ground plane element, to thereby physically trap said second cable against said bottom surface of said ground plane element.

4. The method of claim 1 including the steps of:

forming a second pair of generally linear, side-aligned, and physically spaced through-slots in said ground plane element;

said second pair of through-slots extending normal to said first and second linear fold line areas;

said second pair of through-slots defining a second soldering area on a portion of said ground plane element between said second pair of through-slots; and soldering said second conductor to said second soldering area.

5. The method of claim 4 wherein said first cable is a coaxial cable, wherein said first conductor is a centrally located conductor at one end of said coaxial cable, and wherein said second conductor is an exposed metal sheath at said one end of said coaxial cable.

6. The method of claim 4 including the steps of:

providing said dielectric layer as an air dielectric layer;

providing said first cable as a coaxial cable having an outer metal sheath and an inner electrically insulated metal conductor;

soldering said metal sheath to said second soldering area and on a side of said ground plane element that is opposite to said radiating element;

providing a first through-hole in said ground plane element;

extending said electrically insulated metal conductor through said first through-hole and through said air dielectric layer;

providing a second though-hole in said radiating element and within said first soldering area;

extending an uninsulated end of said metal conductor through said second through-hole; and soldering said uninsulated end of said metal conductor to a side of said radiating element that is opposite to said ground plane element.

7. The method of claim 6 wherein said step of bending said flat metal sheet physically positions said radiating element in a plane that is generally parallel to a plane occupied by said ground plane element.

8. The method of claim 6 wherein said step of bending said flat metal sheet physically positions said radiating element in a plane that is generally tilted to a plane occupied by said ground plane element.

9. The method of claim 8 wherein said plane that is occupied by said radiating element is inclined in a direction such that said shorting element defines a closest distance from said radiating element to said ground plane element.

10. The method of claim 6 including the steps of:

forming a first U-shaped through-slot in said ground plane element, to thereby form a first metal tab in said ground plane element;

said first U-shaped through-slot having a relatively shorter dimension base portion that extends generally parallel to said fold line areas, and said first U-shaped through-slot having two parallel and relatively longer leg portions that extend generally normal to said fold line areas;

bending said first metal tab downward and away from a bottom surface of said ground plane element, bending said bend down first metal tab upward toward the bottom surface of said ground plane element to thereby form a first clip; and positioning said coaxial cable adjacent in said first clip.

11. The method of claim 10 wherein a portion of said ground plane element is free of overhang by said radiating element, and including the steps of:

providing a GPS device having an antenna and a conductor-cable extending from said GPS device;

mounting said GPS device on said portion of said ground plane element such that said ground plane element functions as a ground plane for said GPS device;

forming a second U-shaped through-slot in said ground plane element, to thereby form a second metal tab in said ground plane element;

said second U-shaped through-slot having a relatively shorter dimension base portion that extends generally parallel to said fold line areas, and said second U-shaped through-slot having two parallel and relatively longer leg portions that extend both generally normal to said fold line areas;

bending said second metal tab downward and away from the bottom surface of said ground plane element;

bending said bend down second metal tab upward toward the bottom surface of said ground plane element to thereby form a second clip; and positioning said conductor-cable in said second clip.

12. An antenna assembly, comprising:

a generally U-shaped, one piece, metal sheet having a generally planar ground plane element, a generally planar radiating element, and a rectangular-shaped connecting element that at least partially physically supports said radiating element in spaced relation to said ground plane element;

said connecting element meeting said ground plane element at a first linear line;

said connecting element meeting said radiating element at a second linear line that is parallel to said first linear line;

a first pair of side-aligned and parallel through-slots formed in said radiating element, said first pair of through-slots extending perpendicular to said linear lines, and a portion of said radiating element between said first pair of through-slots comprising a first soldering-area; and a feed cable having one end that includes a first metal conductor that is connected to said ground plane element and a second metal conductor that is soldered to said first soldering-area.

13. The antenna assembly of claim 12 including:

a second pair of side-aligned and parallel through-slots formed in said ground plane element, said second pair of through-slots extending perpendicular to said linear lines, and a portion of said ground plane element between said second pair of through-slots comprising a second soldering-area; wherein said first metal conductor that is soldered to said second soldering-area.

14. The antenna assembly of claim 13 wherein said feed cable is a coaxial cable having a center conductor soldered to said first soldering area, and having a metal sheath soldered to said second soldering area.

15. An antenna, comprising:

a generally U-shaped metal sheet having a generally planar ground plane element, a generally planar radiating element, and a rectangular-shaped connecting element that at least partially physically supports said radiating element in spaced relation to said ground plane element;

said connecting element joining said ground plane element at a first linear joining-line;

said connecting element joining said radiating element at a second linear joining-line that is parallel to said first joining-line;

a first pair of side-aligned and parallel through-slots formed in said radiating element, said first pair of through-slots extending perpendicular to said joining-lines, and a portion of said radiating element between said first pair of through-slots forming a first soldering-area;

a second pair of side-aligned and parallel through-slots formed in said ground plane element, said second pair of through-slots extending perpendicular to said joining-lines, and a portion of said ground plane element between said second pair of through-slots forming a second soldering-area;

a first through-hole formed in said ground plane element;

a second through-hole formed in said radiating element and within said first soldering-area;

a first cable;

said first cable having a first metal conductor that is soldered to said second soldering-area on a surface of said ground plane element that is opposite said radiating element; and said first cable having a second metal conductor that extends through said first through-hole, between said ground plane element and said radiating element, through said second through-hole, and is soldered to said first soldering-area on a surface of said radiating element that is opposite said ground plane element.

16. The antenna of claim 15 including:

a first U-shaped through-slot formed in said ground plane element;

said first U-shaped slot having a base portion that extends parallel to said joining-lines, and having a pair of parallel legs that extend perpendicular to said joining-lines; and a first metal tab formed by said first U-shaped through-slot, said first metal tab being bent to strain-relief-secure said first cable against said surface of said ground plane element that is opposite said radiating element.

17. The antenna of claim 16 wherein said radiating element is of a smaller size than said ground plane element, such that a portion of said ground plane element is free of overhang by said radiating element, the antenna including:

an antenna device mounted on said portion of said ground plane element in a manner to cause said ground plane element to provide a ground plane function for said antenna device;

a second cable connected to said antenna device;

a second U-shaped through-slot formed in said ground plane element;

said second U-shaped slot having a base portion that extends parallel to said joining-lines, and having a pair of parallel legs that extend perpendicular to said joining-lines; and a second metal tab formed by said second U-shaped through-slot, said second metal tab being bent to physically strain-relief-secure said second cable against said surface of said ground plane element that is opposite said radiating element.

18. The antenna of claim 17 wherein said antenna device is a GPS device.

19. A patch antenna, comprising:

a generally planar and metallic ground plane in which currents flow in a given direction, said ground plane having a top surface and a bottom surface;

a generally planar and metallic radiating patch in which currents flow in said given direction, said radiating element having a top surface and a bottom surface;

said radiating patch being physically spaced vertically above said ground plane with said bottom surface of said radiating patch facing said top surface of said ground plane element;

a first pair of physically spaced and linear through-slots formed in said ground plane, said first pair of through-slots being mutually parallel and extending in said given direction of current flow, and said first pair of through-slots defining a first soldering area therebetween;

a second pair of physically spaced and linear through-slots formed in said radiating patch, said second pair of through-slots being mutually parallel and extending in said given direction of current flow, and said second pair of through-slots defining a second soldering area therebetween;

a generally linear coaxial cable having an outer located metal braid and a center located metal feed conductor, said coaxial cable extending in a direction parallel to a plane of said ground plane element with said metal braid in physical engagement with and soldered to said first soldering area; and a first opening in said ground plane through which said center conductor extends generally vertically upward to terminate in physical engagement with and soldered to said second soldering area.

20. The patch antenna of claim 19 including:

a second opening in said radiating element within said second soldering area, said center conductor extends generally vertically upward and through said second opening and soldered to said top surface of said radiating patch.

21. The patch antenna of claim 19 including:

a first cable mechanical strain relief tab formed in said ground plane, said first strain relief comprising a first generally linear metal mounting tab that is cut from said ground plane and bent down from said bottom surface of said ground plane, said first mounting tab extending in said given direction of current flow.

22. The patch antenna of claim 21, including:

a GPS antenna useful for location determination mounted on said top surface of said ground plane, said GPS antenna having a cable extending therefrom; and a second cable mechanical strain relief tab formed in said ground plane, said second strain relief comprising a second generally linear metal mounting tab that is cut from said ground plane and bent down from said bottom surface of said ground plane, said second mounting tab extending in said given direction of current flow.

23. The patch antenna of claim 22 including:

a second opening in said radiating element within said second soldering area, said center conductor extends generally vertically upward and through said second opening and soldered to said top surface of said radiating patch.

24. The patch antenna of claim 22 wherein said antenna is a quarter wave antenna.

* * * * *